US009309718B1

(12) United States Patent
Matthew

(10) Patent No.: US 9,309,718 B1
(45) **Date of Patent: *Apr. 12, 2016**

(54) STABLE STEPLADDER WITH UTILITY TRAY

(76) Inventor: Martin Sinclair Matthew, Temecula, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/134,710

(22) Filed: Jun. 15, 2011

Related U.S. Application Data

(63) Continuation-in-part of application No. 12/806,080, filed on Aug. 5, 2010, now Pat. No. 8,701,828.

(51) Int. Cl.
*E06C 1/16* (2006.01)
*E06C 7/14* (2006.01)

(52) U.S. Cl.
CPC .... *E06C 1/16* (2013.01); *E06C 7/14* (2013.01)

(58) Field of Classification Search
CPC ..... E06C 1/00; E06C 1/02; E06C 1/14; E06C 1/16; E06C 1/24; E06C 1/28; E06C 1/3835; E06C 1/18; E06C 7/14; E06C 7/182; E06C 7/423; E05D 11/10; E05D 11/1007; E05D 11/1014; Y10T 16/5406; Y10T 16/544; Y10T 16/5445; Y10T 16/5448; Y10T 16/551
USPC ..... 182/106, 172, 165, 129, 60, 104, 180.1, 182/152; D25/64, 68; 248/210, 211, 238
See application file for complete search history.

(56) References Cited

U.S. PATENT DOCUMENTS 639,603 A * 12/1899 Nelson ..... 182/29
1,134,491 A * 4/1915 Savage ..... 182/172
1,385,319 A * 7/1921 Enke ..... 182/172
3,568,798 A * 3/1971 Pierce ..... 182/172
3,692,143 A * 9/1972 Kummerlin et al. ..... 182/24
3,822,846 A * 7/1974 Jesionowski ..... 248/210
4,147,231 A * 4/1979 Chantler et al. ..... 182/172
4,589,521 A * 5/1986 Finster et al. ..... 182/129
4,641,729 A * 2/1987 Beck et al. ..... 182/172
4,730,802 A * 3/1988 Chatham et al. ..... 248/238
4,824,060 A * 4/1989 Korda ..... 248/210
4,926,968 A * 5/1990 Schumer ..... 182/172
4,949,925 A * 8/1990 Gorecki ..... 248/238
5,058,707 A * 10/1991 Waid ..... 182/120
5,074,377 A * 12/1991 Krause ..... 182/167
5,106,045 A * 4/1992 Bezotte ..... 248/210

(Continued)

FOREIGN PATENT DOCUMENTS

GB 2127472 A * 4/1984 ..... E06C 1/32

*Primary Examiner* — Charles A Fox
*Assistant Examiner* — Kristine Florio

(57) ABSTRACT

The present invention is used on stepladders that are structured to provide improved lateral stability, step support and equipment/supplies support for stepladder users. The stepladder may have a step element and a support element rotatably attached at a top platform or a first step element rotatably attached to a second step element adjacent a top step. A hinged strut may be attached at opposed ends between the opposed elements intermediate the ladder top and the ladder base. A plurality of steps may be spaced apart and attached between step rails of step elements. A lateral support leg may be rotatably attached at a top end to each of the step rails intermediate a second step and a third step from the ladder top and a hinged leg strut may be attached at opposed ends between each of the support rails and lateral support legs.

4 Claims, 5 Drawing Sheets

(56) References Cited

U.S. PATENT DOCUMENTS

| | | | | |
|---|---|---|---|---|
| 5,590,739 | A * | 1/1997 | High et al. | 182/169 |
| 6,799,660 | B1 * | 10/2004 | Crawford | 182/200 |
| 7,017,711 | B1 * | 3/2006 | Ali | 182/201 |
| D560,001 | S * | 1/2008 | Moss et al. | D25/68 |
| 2002/0074187 | A1 * | 6/2002 | Bendle et al. | 182/172 |
| 2004/0245045 | A1 * | 12/2004 | Shai | 182/17 |
| 2005/0029042 | A1 * | 2/2005 | Latimer et al. | 182/77 |
| 2005/0121261 | A1 * | 6/2005 | Moss et al. | 182/165 |
| 2005/0127254 | A1 * | 6/2005 | Scott et al. | 248/188 |
| 2006/0137937 | A1 * | 6/2006 | Pratt | 182/129 |
| 2009/0229918 | A1 * | 9/2009 | Moss et al. | 182/129 |
| 2009/0250294 | A1 * | 10/2009 | Byers | 182/129 |
| 2010/0096215 | A1 * | 4/2010 | McFarlane | 182/106 |
| 2010/0155177 | A1 * | 6/2010 | Tydings, III | 182/129 |
| 2011/0079467 | A1 * | 4/2011 | Mares | 182/129 |

* cited by examiner

STABLE STEPLADDER WITH UTILITY TRAY

CROSS-REFERENCE TO RELATED APPLICATIONS

This is a continuation-in-part patent application of U.S. patent application Ser. No. 12/806,080, filed on Aug. 5, 2010. U.S. patent application Ser. No. 12/806,080 is pending

BACKGROUND OF THE INVENTION

This invention relates to stepladder structure to improve ladder lateral stability and provide utility devices adjacent the top of the ladder. The new ladder structure includes four deployable lateral support legs and at least one utility support tray attached adjacent the top of the ladder.

The concept of increasing a stepladder total width at the base of the ladder may be known. There are various issued patents that disclose and discuss that this feature has been established as an important element for ladder stability. Likewise there are a variety of disclosures and issued patents with lateral stability elements. However, the various advancements in this field of the art still show there is a need for improvement of the structure of a stepladder for stability that may be a combination of ladder strength as well as the structure of deployable lateral support legs, width of ladder rungs and availability of utility support trays. A properly structured ladder may allow use of existing ladder transport equipment, storage facilities, shipping space and other ladder accessories.

SUMMARY OF THE INVENTION

The present invention is directed to stepladders that are structured to provide improved lateral stability, step support and equipment/supplies support for stepladder users. The stepladder may have a step element and a support element rotatably attached at a top platform or a first step element rotatably attached to a second step element adjacent a top step. A hinged strut may be attached at opposed ends between the opposed elements intermediate the ladder top and the ladder base. A plurality of steps may be spaced apart and attached between step rails of step elements. A lateral support leg may be rotatably attached at a top end to each of the step rails intermediate a second step and a third step from the ladder top and a hinged leg strut may be attached at opposed ends between each of the support rails and lateral support legs.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 2:
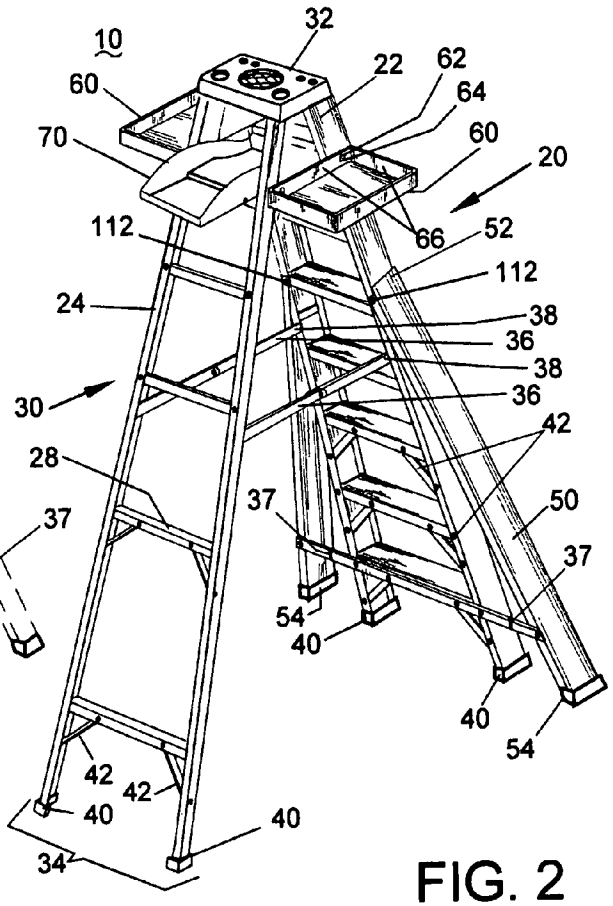
FIG. 2 illustrates a rear perspective elevation view of a stepladder according to an embodiment of the invention.
Figure 1:
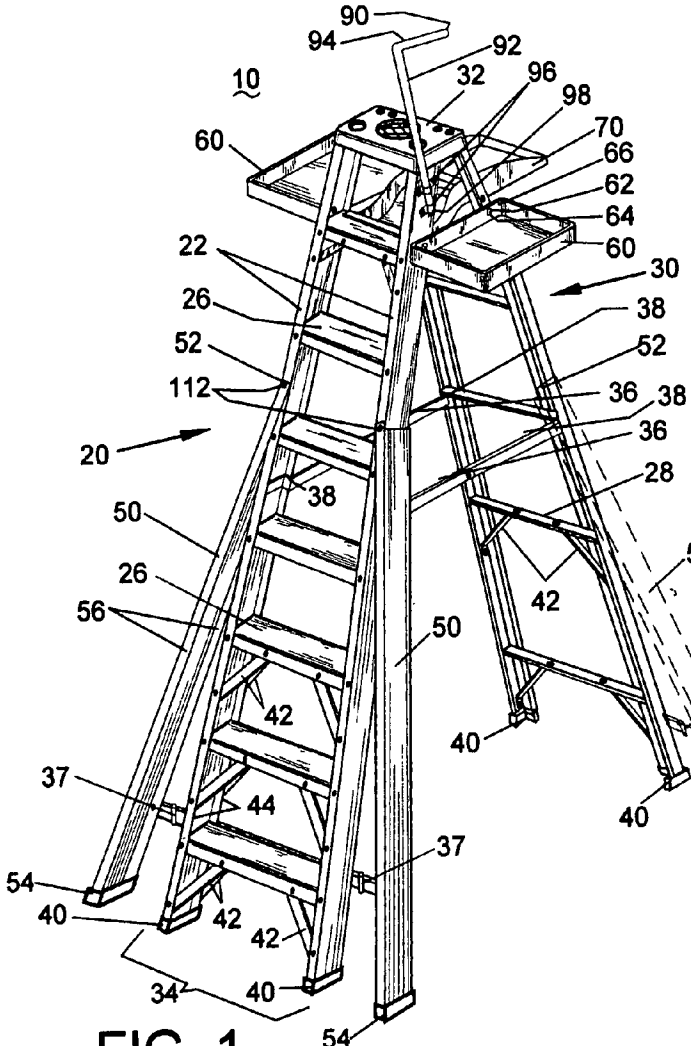
FIG. 1 illustrates a front perspective elevation view of a stepladder according to an embodiment of the invention.
Figure 4:
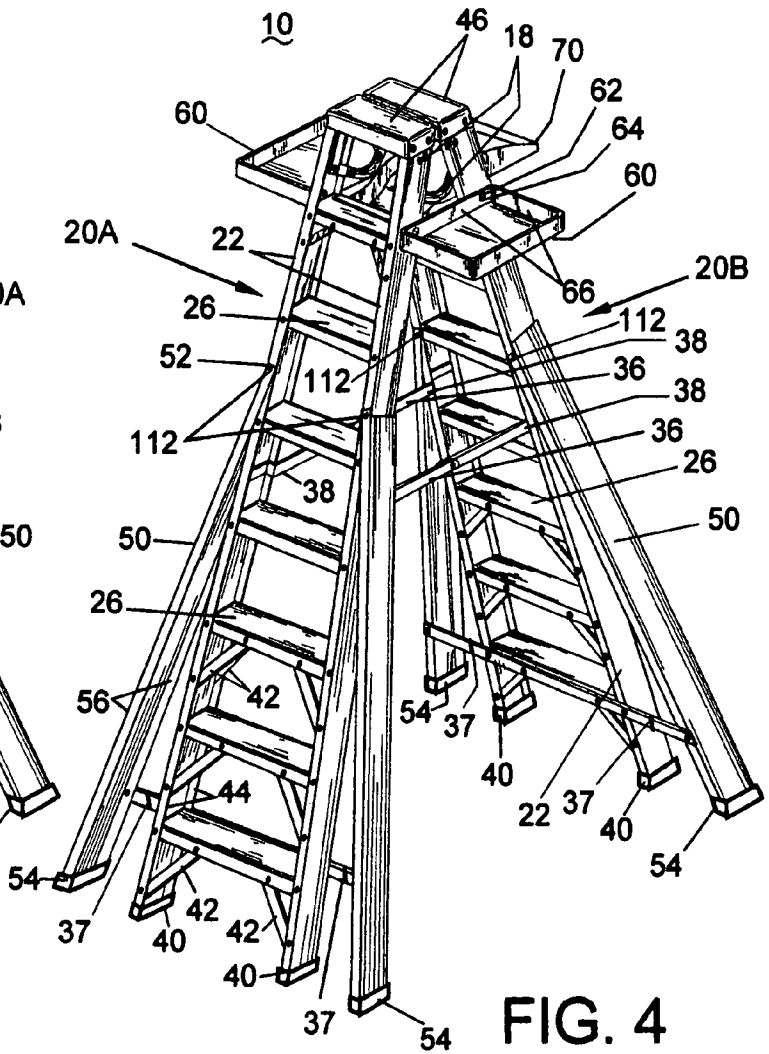
FIG. 4 illustrates a reverse perspective elevation view of FIG. 3 according to an embodiment of the invention.
Figure 3:
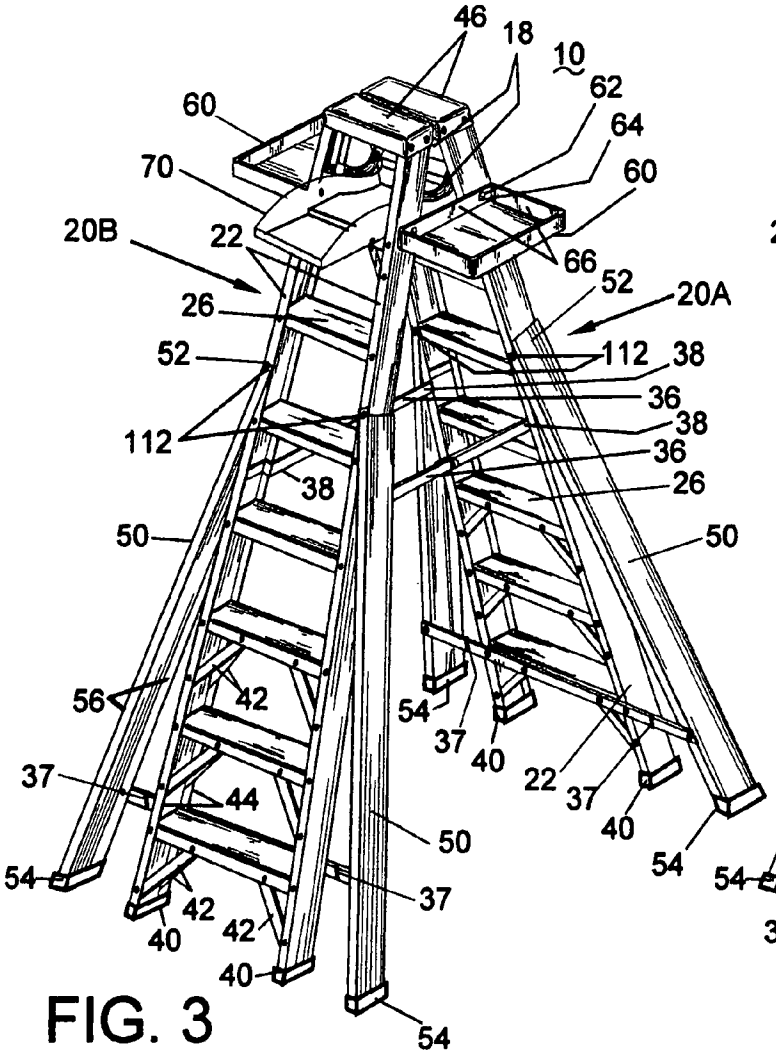
FIG. 3 illustrates a front perspective elevation view of a two step element stepladder according to an embodiment of the invention.
Figure 7:
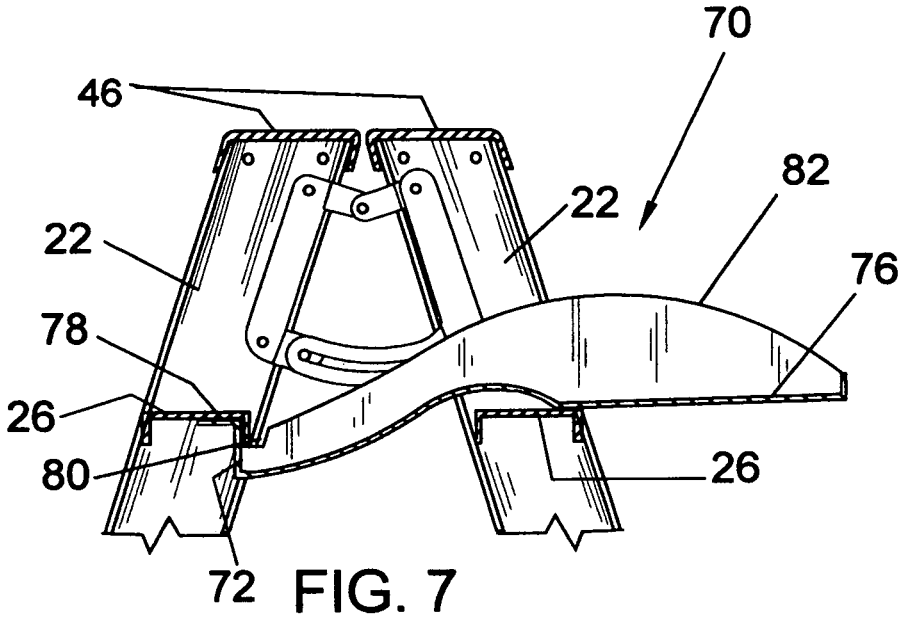
FIG. 7 illustrates a side partial section view of a ladder top with extended tray according to an embodiment of the invention.
Figure 6:
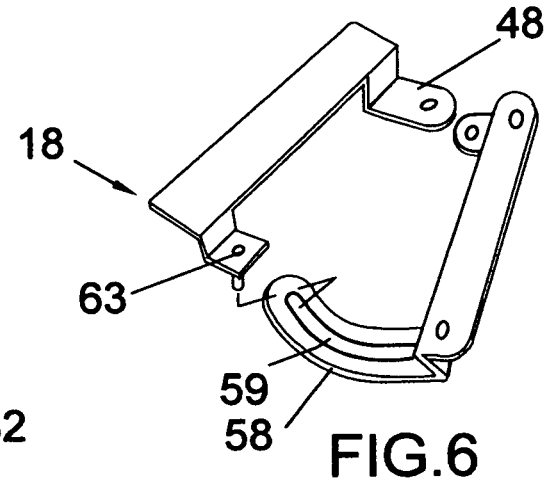
FIG. 6 illustrates a side view of a hinge and strut combination according to an embodiment of the invention.
Figure 5:
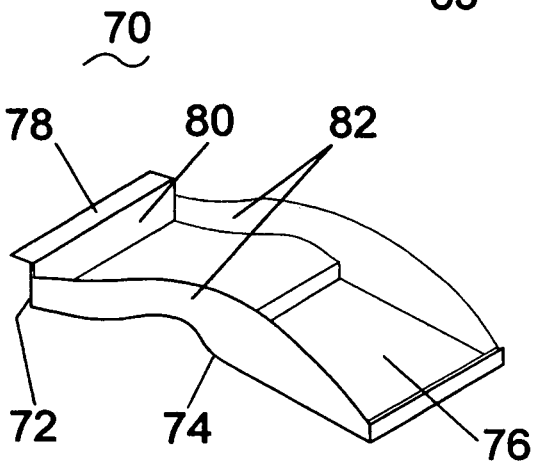
FIG. 5 illustrates a top perspective view of an extended tray according to an embodiment of the invention.

Referring to FIGS. 1 and 2, a stepladder 10 may have a step element 20 and a support element 30 rotatably attached at a top platform 32 and connected intermediate to the top platform 32 and the ladder base 34 by a hinged strut 36 attached at opposed ends 38 to each adjacent step rail 22 and support rail 24. The step rails 22 may have steps 26 attached between the two step rails 22 spaced apart a distance selected for climbing use of the ladder 10. The steps 26 may have a width of 4½ inches from the front edge to the back edge of a step 26 to allow stable support of a user's feet.

The support rails 24 may have horizontal support members 28 attached between the two support rails 24 spaced apart a distance selected for structural support of the ladder 10. Angular braces 42 may be attached between one or more of the steps 26 and the step rails 22 and between the support members 28 and the support rails 24 to strengthen the ladder 10. The angular braces 42 may be attached in pairs at each side wall 44 of the rails 22, 24 and steps 26 or support member 28.

Deployable lateral support legs 50 may be rotatably attached at a top end 52 by a rotatable fastener 112 to each of the step rails 22 and lateral legs 51 may be attached at a top end 49 by a fastener 112 to each of the support rails 24. A hinged strut leg 37 may be attached at opposed ends 38 between each of a step rail 22, or a support rail 24 and a lateral support leg 50 or a lateral leg 51. When a leg 50 is deployed the hinged leg strut 37 may support the foot 54 or bottom end of the leg 50 a predetermined distance from the bottom end 40 of a rail 22, 24. The legs 50 may be structured as "U" shape or open channel beams with side walls 56 spaced apart sufficiently to allow the legs 50 when moved against a rail 22, 24 to overlap the rail 22, 24 with the side walls 56 positioned on the rail 22, 24 side walls 44. When the legs 50 are in the stowed position the ladder 10 step and support members 20, 30 may present a narrow profile similar to standard stepladders. The stepladder 10 with stowed legs 50 may be stored, transported and shipped using existing stepladder handling equipment.

Figure 10:
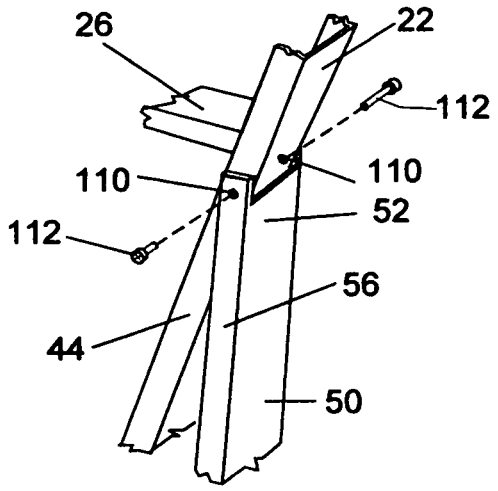
FIG. 10 illustrates a partial perspective view of a stepladder step rail with a lateral support leg attached according to an embodiment of the invention.
Figure 11:
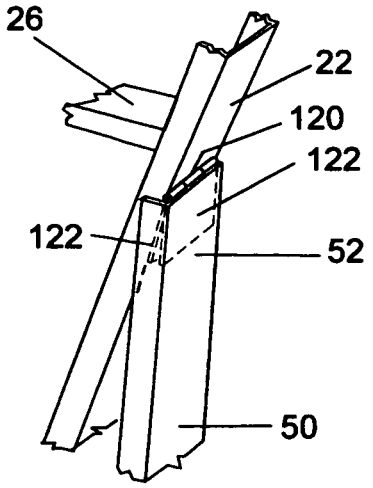
FIG. 11 illustrates a partial perspective view of a stepladder step rail with a lateral support leg attached according to an embodiment of the invention.
Figure 12:
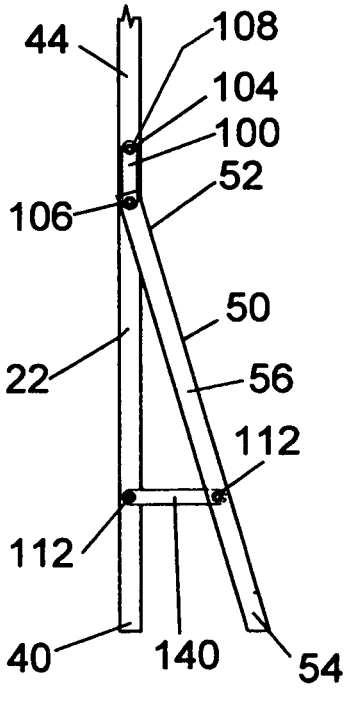
FIG. 12 illustrates a partial side elevation view of a stepladder step rail with a lever strut and a lateral support leg attached according to an embodiment of the invention.
Figure 13:
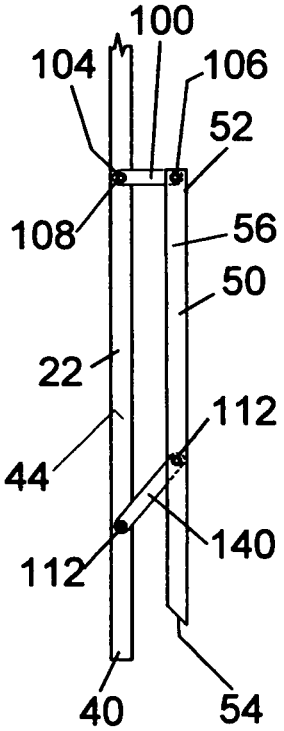
FIG. 13 illustrates a partial side elevation view of a stepladder step rail with a lever strut and a lateral support leg attached according to an embodiment of the invention.
Figure 14:
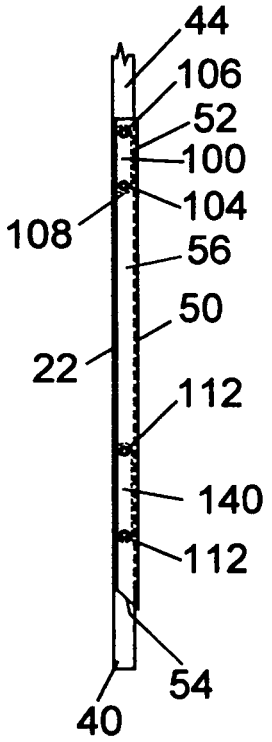
FIG. 14 illustrates a partial side elevation view of a stepladder step rail with a lever strut and a lateral support leg attached according to an embodiment of the invention.

Referring to FIGS. 1, 2, 10 and 11, the lateral support legs 50 may be rotatably attached at the top end 52 by use of cylindrical bar elements 112, for example, pins, nuts and bolts, rivets and the like, positioned in aligned holes 110 in the side walls 44 of the step rails 22 and in the side walls 56 of the support legs 50 as best seen in FIG. 10. The rotatable attachment may also be implemented with a plate or leaf hinge 120 that has a hinge element 122 or plate attached to a step rail 22 and at the top end 52 of the support leg 50 as best viewed in FIG. 11.

Referring to FIGS. 1, 2, 12, 13 and 14, the lateral support legs 50 may each be rotatably attached at the top end 52 to one end 106 of a pair of a lever struts 100 that is are attached at a second end 108 to a fulcrum 104 that is attached to a each side wall 44 of the each step rail 22. A pair of lower struts 140 may be rotatably attached at opposed ends 142 between each of a rail 22 and a support leg 50. When a support leg 50 is deployed the lever struts 100 may rotate to subtend downwardly from the fulcrum 104 and the lower struts 140 may rotate to extend generally horizontally between a step rail 22 and the support leg 50, see FIG. 12. When the support leg 50 is moved to the stowed position the lever struts 100 may rotate upwardly to be positioned between the side walls 44 of the step rail 22 and the side walls 56 of the support leg 50. The lower struts 140 may also rotate upwardly to be positioned between the side walls 44, 56.

The legs 50 may be attached intermediate the second and third step of the step element 20 to allow optimal stability support for the stepladder 10 when the legs 50 may be deployed. General practice for safe use of a stepladder may be to not climb the ladder higher than the second or third step from the top platform 32. Experiments with stepladders 10 have demonstrated that a reasonable separation distance between the step rail 22 bottom end 40 and the leg 50 foot 54 for ladder stability may be to approximately double the width of the base 34. An equivalent attachment distance from the top 32 and for the separation distance between the bottom end 40 and foot 54 for the support rails 24 when used with legs 50 also may improve ladder 10 stability.

For additional safe use of the stepladder 10, utility trays 60 may be attached adjacent to the top platform 32 in position to hold tools, supplies, paint and the like for ease of access to a user of the stepladder 10. Trays 60 may be attached by slidable engagement of one or more slots 64 formed in a side 66 of the tray 60 with capped lugs 62 that are attached to the upper portion of the rails 22, 24. The tray 60 may have four sides 66 that may be 2 inches high to retain elements in the tray 60. The tray 60 may also be structured as a paint tray to hold paint for a user to apply paint to a paint roller (not shown). The tray 60 may have a width to extend outwardly from a side of the ladder 10 a distance approximately equal to the deployed distance between a bottom end 40 and foot 54 to allow placement of a ladder 10 abut a vertical structure.

Referring to FIGS. 1, 2, 5 and 7, an extending tray 70 may be structured to have a step end 72 that can be retained under a step 26 and a tray end 74 positionable on a support member 28 to position a tray pan 76 outwardly from the ladder 10 opposite a user climbing side. The extending tray 70 may have an elongated flange 78 on a back bar 80 that is attached to two beam members 82 that extend generally orthogonally from the back bar 80 to the tray end 74 to support the tray pan 76.

Referring to FIGS. 3, 4, 6 and 7 the stepladder 10 may have a first step element 20A and a second step element 20B rotatably attached at a top step 46. In this configuration there is no support element 30. The step elements 20A, 20B may be the same structure as that described for step element 20 with step element 20A and step element 20B being rotated 180 degrees relative to each other. A hinge 48 may be used to attach each top step 46. A strut 58 having a slot 59 may be attached at one end to each step rail 22 of one step element 20 with the slot 59 engage with a capped lug 63 attached to each step rail 22 of the second step element 20. The hinge and strut combination 18 may improve stability of the abutting top steps 46. Use of a first step element 20A and second step element 20B may allow more versatile use of the stepladder 10. To the extent the step element 20 may have stronger structural elements than the support element 30, the two step element 20A, 20B structure may have additional stability.

Evaluation of the stepladder 10 structure, particularly the dual step element ladder 20A, 20B, by medical professionals found that the generally rigid structure with the long support legs 50 and the wide steps 26 allowed better balance with less stress to the entire muscular-skeletal system. Unnecessary stress applied to the body can in turn cause conditions such as neck pain, upper back pain, pain across the shoulders, middle back pain, lower back pain, hip pain, knee pain and foot/ankle pain. The added stress and strains can also cause the body to fatigue more quickly, which in turn can lead to both physical and mental fatigue and impairment. The stability elements in the structure of the stepladder 10 should reduce these stress issues and the chance of injury for ladder users.

Figure 9:
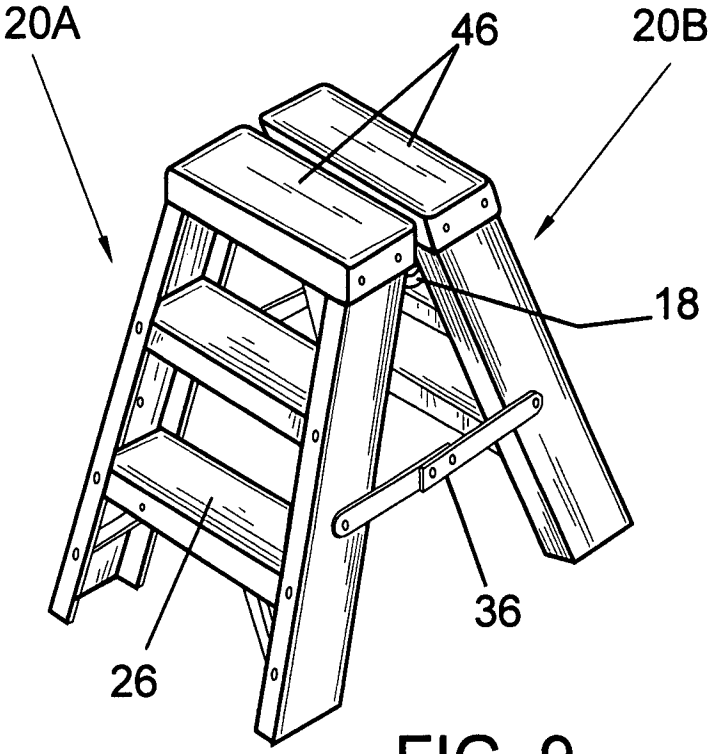
FIG. 9 illustrates a reverse perspective elevation view of FIG. 8 except for elements 90 through 98 according to an embodiment of the invention.
Figure 8:
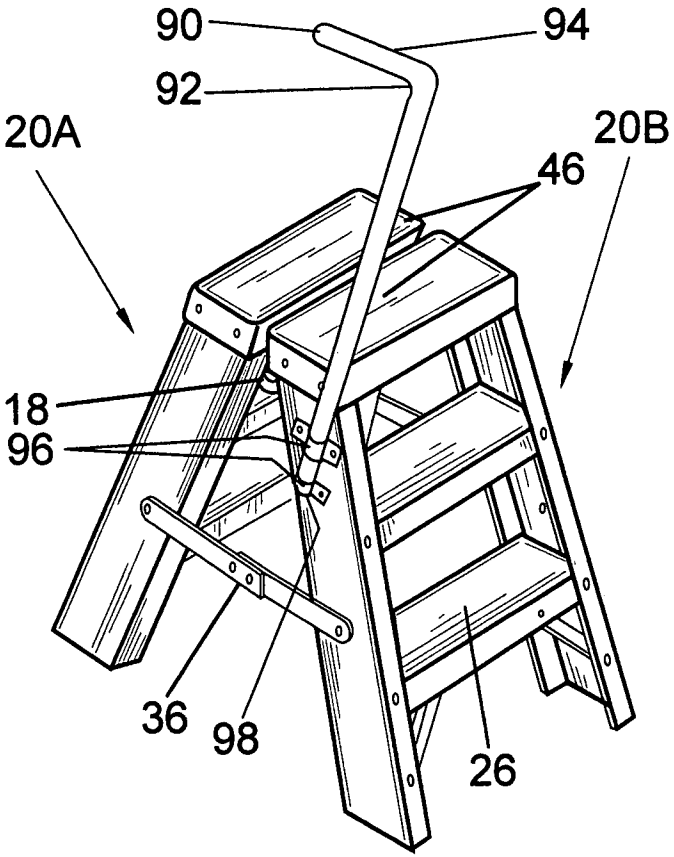
FIG. 8 illustrates a front perspective elevation view of a shortened configuration of a stepladder according to an embodiment of the invention.

Referring to FIGS. 8 and 9, the stepladder 10 may be constructed with various heights or rail 22, 24 lengths, for example, 6 foot, 12 foot and the like. A configuration of the two step element 20A, 20B structure may be constructed with a low height of perhaps 3 feet and may not included the lateral support legs 50. Use of the two step element 20A, 20B configuration and the wide steps of 4½ inches may provide a sturdy, stable stand on which a user may stand on the abutting top steps 46.

Referring to FIGS. 1 and 8, a safety handle 90 may be used with the stepladder 10 to allow a user a structure adjacent the top of stepladder 10 to grip for stability when standing near the top or on a short ladder 10 when standing on the top step 46. The safety handle 90 may have an elongated shaft 92 that may be slidably inserted in clamps 96 that are attached to a step rail 22. The lower clamp 96 may have a stop element 98. There may be an angular bar 94 that may be attached approximately orthogonally to the top of the elongated shaft 92 for ease in gripping the safety handle.

While the invention has been particularly shown and described with respect to the illustrated embodiments thereof, it will be understood by those skilled in the art that the foregoing and other changes in form and details may be made therein without departing from the spirit and scope of the invention.

I claim:

1. A stepladder comprising:

a step element and a support element each rotatably attached in opposed relationship at a top platform wherein said step element has two spaced apart step rails with a plurality of steps spaced apart and attached therebetween, and said support element has two spaced apart support rails with at least one support member attached therebetween;

a hinged strut is attached between each step rail and each opposed support rail intermediate said top platform and a ladder base;

two lateral support legs each have a lever strut rotatably attached at a first end to a top end of each of said lateral support legs and one of each of said two lateral support legs is rotatably attached at a second end to each of said step rails intermediate a second step and a third step from said top platform;

a lower strut is rotatably attached at opposed ends to said lateral support leg and said step rail below and spaced apart from said lever strut;

wherein when said lateral support legs are deployed, a foot end of each is spaced apart from its attached step rail one half the width of the distance between a bottom end of each of said two step rails; and wherein a first capped lug is attached adjacent said top platform on said step rail and a second capped lug is attached adjacent said top platform on said support rail; and a utility tray having four side walls with one of said side walls having at least two slots formed therein for engagement with said capped lugs is disposed on the stepladder.

2. The stepladder as in claim 1 wherein said utility tray has a width to extend perpendicularly from the plane of said first capped lug and second capped lug from said step rail a distance approximately equal to the separation distance between a bottom end of said step rail and a foot of said lateral support leg when deployed.

3. A stepladder comprising:

a first step element and a second step element each with a first step rail, a second step rail and a top step wherein said first step element and said second step element are rotatably attached by a first hinge and strut combination that is attached at a first end to said first step rail of said first step element and at a second end to said first step rail of said second step element and by a second hinge and strut combination that is attached at a first end to said second step rail of said first step element and at a second end to said second step rail of said second step element wherein said first hinge and strut combination and said second hinge and strut combination are disposed adjacent to and below said top step of each of said first step element and said second step element wherein each of said first and second hinge and strut combinations is a hinge spaced apart from a strut wherein said strut is positioned below said hinge and a slot in said strut is engaged with a capped lug in said strut;

a hinged strut is attached at opposed ends between each of said first step rails and between each of said second step rails of said first step element and said second step element intermediate said top steps and a ladder base;

a plurality of steps spaced apart and attached between said first and second step rails of said first step element and said first and second step rails of said second step element;

a plurality of lateral support legs each have a lever strut rotatably attached at a first end to a top end of each of said lateral support legs, and one of each of said lever struts at a second end is rotatably attached intermediate a second step and a third step from said top step of said first step element to each of said first and second step rails of said second step element to each of said first and second step rails;

a lower strut is rotatably attached at opposed ends to each of said lateral support legs and said first and second step rails below and spaced apart from said lever strut;

wherein when said lateral support legs are deployed, a foot end of each is spaced apart from its attached step rail one half the width of the distance between a bottom end of each of said first and second step rails; and wherein a capped lug is attached adjacent said top steps on each of said first step rails and said second step rails, and a utility tray having four side walls with one of said side walls having at least two slots formed therein for engagement with said capped lugs is disposed on the stepladder.

4. The stepladder as in claim 3 wherein a safety handle has an elongated shaft with an angular bar attached approximately orthogonally at one end and a clamp is attached to one of said step rails adjacent said top step wherein said clamp is disposed for slidable insertion of said elongated shaft to position said angular bar above said top step and to retain said elongated shaft.

* * * * *